US008494688B2

(12) United States Patent
Alfano

(10) Patent No.: US 8,494,688 B2
(45) Date of Patent: Jul. 23, 2013

(54) SYSTEM AND METHOD FOR DETECTION OF ANTI-SATELLITE VULNERABILITY OF AN ORBITING PLATFORM

(75) Inventor: Salvatore Alfano, Monument, CO (US)

(73) Assignee: Analytical Graphics Inc., Exton, PA (US)

( * ) Notice: Subject to any disclaimer, the term of this patent is extended or adjusted under 35 U.S.C. 154(b) by 744 days.

(21) Appl. No.: 12/837,928

(22) Filed: Jul. 16, 2010

(65) Prior Publication Data

US 2012/0016537 A1 Jan. 19, 2012

(51) Int. Cl.

| | |
|---|---|
| ***G05D 1/00*** | (2006.01) |
| ***G05D 3/00*** | (2006.01) |
| ***G08B 21/00*** | (2006.01) |

(52) U.S. Cl.

USPC ..... 701/3; 340/945; 244/3.1; 244/158.1

(58) Field of Classification Search

None

See application file for complete search history.

(56) References Cited

U.S. PATENT DOCUMENTS

| | | | | |
|---|---|---|---|---|
| 4,478,581 | A * | 10/1984 | Goda | 434/22 |
| 6,209,820 | B1 * | 4/2001 | Golan et al. | 244/3.15 |
| 6,961,070 | B1 * | 11/2005 | Madison et al. | 345/632 |
| 2003/0225546 | A1 * | 12/2003 | Alfano et al. | 702/150 |
| 2005/0086227 | A1 * | 4/2005 | Sullivan et al. | 707/7 |
| 2005/0228622 | A1 * | 10/2005 | Jacobi | 703/2 |
| 2006/0238403 | A1 * | 10/2006 | Golan et al. | 342/62 |
| 2007/0032984 | A1 * | 2/2007 | Alfano | 702/181 |
| 2009/0035730 | A1 * | 2/2009 | Lindero | 434/22 |
| 2009/0192962 | A1 * | 7/2009 | Rigdon et al. | 706/46 |
| 2010/0049440 | A1 * | 2/2010 | Alfano | 701/301 |
| 2010/0250137 | A1 * | 9/2010 | Hoots | 701/301 |
| 2012/0013478 | A1 * | 1/2012 | Alfano | 340/815.4 |
| 2012/0016537 | A1 * | 1/2012 | Alfano | 701/3 |
| 2012/0016541 | A1 * | 1/2012 | Alfano | 701/13 |

OTHER PUBLICATIONS

Roger R. Bate, Donald D. Mueller, Jerry E. White Fundamentals of Astrodynamics Jun. 1, 1971 Dover Publications, edition 1, ISBN 0486600610.*

* cited by examiner

*Primary Examiner* — Fadey Jabr
*Assistant Examiner* — Krishnan Ramesh
(74) *Attorney, Agent, or Firm* — The Marbury Law Group, PLLC

(57) ABSTRACT

A system and method for detection of anti-satellite vulnerability of an orbiting platform. An engagement volume processing unit receives a maximum impulse velocity of an SBI launched from a carrier platform of interest, a maximum time of flight (TOF) until intercept, and orbital data of the carrier platform of interest. A family of interceptor imparted velocities in a VNC frame is determined. The engagement volume processing unit applies the family of velocities over "N" release points using a carrier platform propagator to determine an engagement volume. A display and alert processing unit generates a visual representation of the engagement volume and sends the visual representation to the display device for display.

16 Claims, 4 Drawing Sheets

SYSTEM AND METHOD FOR DETECTION OF ANTI-SATELLITE VULNERABILITY OF AN ORBITING PLATFORM

BACKGROUND

Satellites have become critical to both military and commercial endeavors, making them a high priority in an adversary's target list.

The interest in space-based weapons and the proliferation of space technology to potential adversaries has caused planners to become concerned regarding the vulnerability and survivability of their satellites, especially to co-orbiting systems. Timely prediction of such a threat presents some unique challenges because such an intercept system would already be in orbit and could launch at any time. Since there might be precious few minutes for a surveillance system to observe the release of a co-orbiting anti-satellite weapon and then determine its target, pre-analysis could be used to heighten vigilance during those times of vulnerability. The targeted satellite would then stand a better chance of maneuvering away from the predicted impact area or deploying some sort of countermeasure.

SUMMARY

Embodiments are directed to systems and methods for producing display constructs that provide visual and textual representation of the vulnerability of a satellite to a space-based interceptor (SBI) launched from an orbiting, anti-satellite, carrier platform.

In an embodiment, a system and method are provided that produces a visual representation of an intercept volume of an SBI with respect to a targeted platform, which representation is derived from the position and velocity vectors of the launching platform, the range of impulsive velocities that can be imparted to the SBI upon deployment, and the maximum expected time-of-flight from release until intercept. In another embodiment, an intercept alert system alerts an operator of a targeted platform of a threat from an SBI.

DETAILED DESCRIPTION

Figure 1:
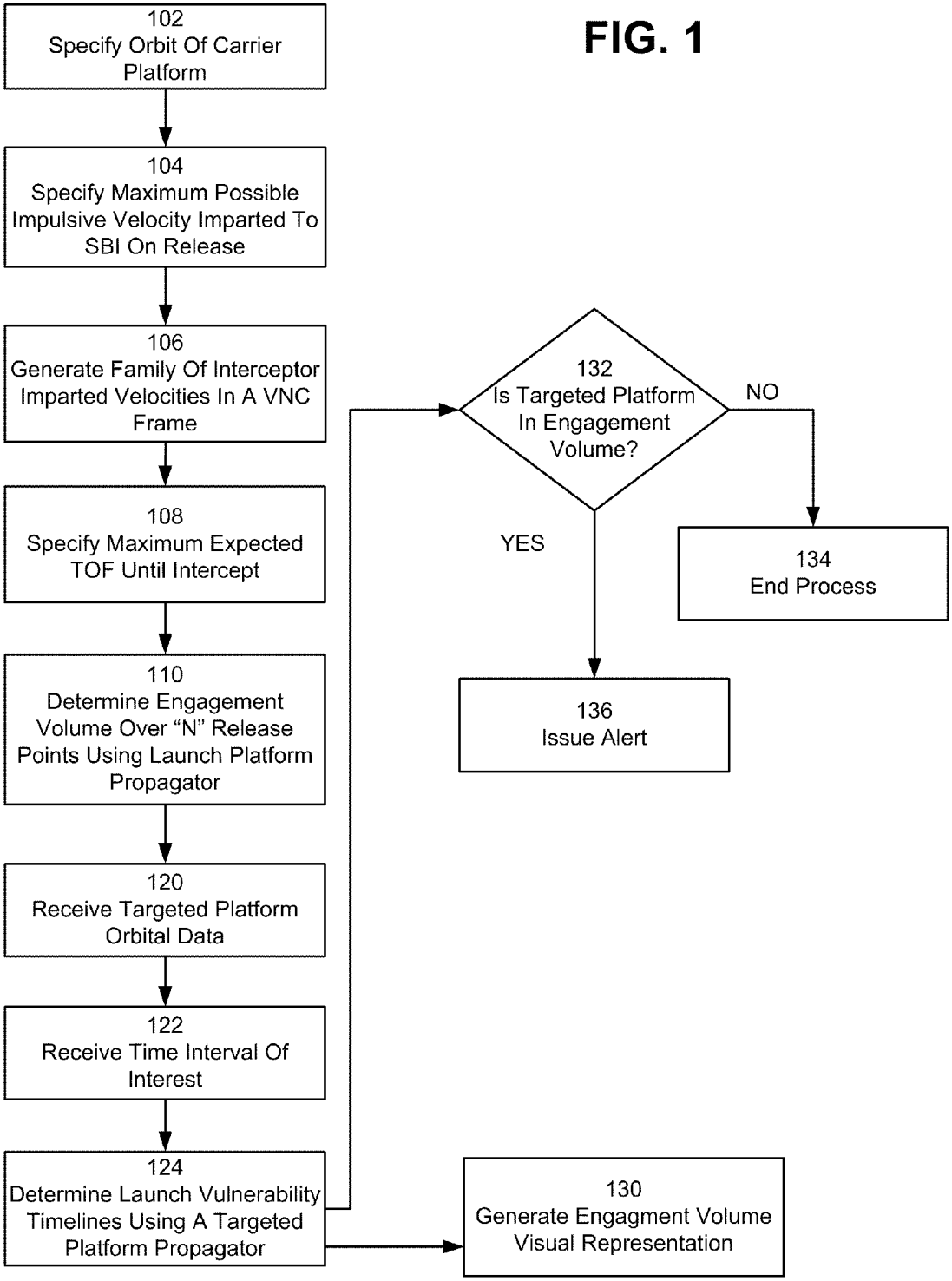
FIG. 1 is a flow diagram illustrating a process of establishing an engagement volume for an SBI according to an embodiment.

As used herein, the term "space-based interceptor" (SBI) encompasses a kinetic energy weapon that is stationed on an orbiting launch platform with the intended purpose of destroying another satellite (sometimes referred to herein as a "targeted platform") in orbit.

In an embodiment, an engagement volume (sometimes referred to as a "kill basket") is determined. The entry and exit times through the engagement volume define the bounds of the vulnerability of a targeted platform for a specific launch platform.

In an embodiment, an engagement volume may be derived from the position and velocity vectors of the launch platform, the range of impulsive velocities that can be imparted to the SBI upon deployment, and the maximum expected time-of-flight from release until intercept. An engagement volume relative to the SBI's launch platform is determined by creating a sufficient family of trajectories based on a wide range of impulsive velocities. The volume itself can be represented in several ways. For example, the results may be displayed relative to the carrier platform as points in space contained within a convex hull or a minimum volume enclosing ellipsoid.

An SBI has three phases of flight: the boost phase (velocity imparted to the SBI upon deployment), the midcourse phase (coast or free-flight), and the terminal phase (final intercept guidance to precisely strike the target satellite). In embodiment, an "alert" determination of vulnerability may be made by assuming the interceptor receives all of its energy upon release from the carrier and follows an orbital path to the target, thereby approximating all three phases as one simple phase. If an alert determination is made, an operator of a targeted platform may take additional steps to more precisely assess the vulnerability of the targeted platform to the SBI in question.

In the discussion that follows, the orbital parameters of the launch platform are given in an Earth-Centered Inertial (ECI) frame. In an embodiment, the ECI frame may be transformed to the Velocity-Normal-Co-normal (VNC) frame. To accomplish this, the ECI 3×1 vectors for position ($pos_{ECI}$) and velocity ($vel_{ECI}$) are used to produce the following:

$$V_{unit} = \frac{vel_{ECI}}{|vel_{ECI}|} \tag{1}$$

$$h = pos_{ECI} \times vel_{ECI} \tag{2}$$

$$N_{unit} = \frac{h}{|h|} \tag{3}$$

$$C_{unit} = V_{unit} \times N_{unit} \tag{4}$$

$$rot_{ECI2VNC} = (V_{unit}\ N_{unit}\ C_{unit})^T \tag{5}$$

The 3×3 matrix of Equation 5 allows proper rotation of the position and velocity of the launch platform between the ECI and VNC frames. The maximum possible impulsive velocities imparted to the SBI upon release are represented in a 6×1 vector ΔV where $$\Delta V = (V_{plus} V_{minus} N_{plus} N_{minus} C_{plus} C_{minus})^T \tag{6}$$

Each axis offers three possibilities for consideration: plus, zero, and minus. Combining axial thrusting allows the modeling of all 26 possible firing combinations ($3^3-1$) plus the null set.

A propagator is an algorithm that moves a satellite in time within its orbit. There is a reasonable possibility that the carrier platform will be in a non-circular orbit. To account for the effects of orbital eccentricity, the relative motion produced by the various firing combinations may be examined using a propagator that is appropriate for the intended accuracy and available data. By way of illustration and not by way of limitation, a propagator may be defined based on the assumptions that all SBI trajectories begin at the carrier platform and follow a simple two-body dynamical path until reaching the target satellite.

The maximum expected time-of-flight (TOF) from release until intercept is taken into account in order to end the propagation. The greater the time-of-flight, the longer the propagation, and the bigger the engagement volume. Because the specific release point is not known in advance, the engagement volume will be different over the course of a noncircular orbit. Therefore, in order to accommodate the carrier's orbital eccentricity, a sufficient number of cases N are examined at various release points (perigee, apogee, and intermediate true anomalies) to capture the complete range of possible intercepts. This results in an all-encompassing vulnerability volume that is static in the VNC frame of the carrier platform. This volume may be somewhat conservative, being slightly larger than it might otherwise be for a specific release point.

Algorithm for Determining Engagement Points

In an embodiment, a user specifies the orbit of the carrier platform, a maximum possible impulsive velocity imparted to the SBI upon release, and the maximum expected time-of-flight until intercept. In an embodiment, a number "N" of release points (perigee, apogee, and intermediate true anomalies) is examined to capture the complete range of possible intercepts. A large N provides a more complete family of intermediate engagement points at the expense of computational speed. In another embodiment, N is an even number, the first release point is at perigee and an apogee release point is included to span the complete range of possibilities.

The computational algorithm is as follows:

Initially compute the orbital period of the carrier platform;

Initially divide orbital period by N to find a fractional orbital period; and

Initially generate a family of interceptor imparted velocities in a VNC frame:

$\Delta V_1=(V_{plus}\ N_{plus}\ C_{plus})^T$
$\Delta V_2=(V_{plus}\ N_{plus}\ 0)^T$
$\Delta V_3=(V_{plus}\ N_{plus}\ C_{minus})^T$
$\Delta V_4=(V_{plus}\ 0\ C_{plus})^T$
$\Delta V_5=(V_{plus}\ 0\ 0)^T$
$\Delta V_6=(V_{plus}\ 0\ C_{minus})^T$
$\Delta V_7=(V_{plus}\ N_{minus}\ C_{plus})^T$
$\Delta V_8=(V_{plus}\ N_{minus}\ 0)^T$
$\Delta V_9=(V_{plus}\ N_{minus}\ C_{minus})^T$
$\Delta V_{10}=(0\ N_{plus}\ C_{plus})^T$
$\Delta V_{11}=(0\ N_{plus}\ 0)^T$
$\Delta V_{12}=(0\ N_{plus}\ C_{minus})^T$
$\Delta V_{13}=(0\ 0\ C_{plus})^T$
$\Delta V_{14}=(0\ 0\ 0)^T$
$\Delta V_{15}=(0\ 0\ C_{minus})^T$
$\Delta V_{16}=(0\ N_{minus}\ C_{plus})^T$
$\Delta V_{17}=(0\ N_{minus}\ 0)^T$
$\Delta V_{18}=(0\ N_{minus}\ C_{minus})^T$
$\Delta V_{19}=(V_{minus}\ N_{plus}\ C_{plus})^T$
$\Delta V_{20}=(V_{minus}\ N_{plus}\ 0)^T$
$\Delta V_{21}=(V_{minus}\ N_{plus}\ C_{minus})^T$
$\Delta V_{22}=(V_{minus}\ 0\ C_{plus})^T$
$\Delta V_{23}=(V_{minus}\ 0\ 0)^T$
$\Delta V_{24}=(V_{minus}\ 0\ C_{minus})^T$
$\Delta V_{25}=(V_{minus}\ N_{minus}\ C_{plus})^T$
$\Delta V_{26}=(V_{minus}\ N_{minus}\ 0)^T$
$\Delta V_{27}=(V_{minus}\ N_{minus}\ C_{minus})^T$ In order to identify the largest potential engagement volume, the carrier platform may be propagated starting at perigee in the Earth Centered Inertial (ECI) frame using the following iteration:

Determine rotation matrix $rot_{ECI2VNC}$ (initial) for carrier platform, where the notation "ECI2VNC" indicates the transformation from the Earth Centered Inertial frame to Velocity-Normal-Co-Normal frame Rotate carrier platform initial position and velocity to VNC frame Propagate carrier platform until maximum expected time-of-flight Compute rotation matrix $rot_{ECI2VNC}$ (final) for the carrier platform Add each imparted velocity ($\Delta V_1$-$\Delta V_{27}$) to carrier platform's initial VNC velocity Propagate each case until maximum expected time-of-flight Identify a sufficient number of points for visualization Rotate points to final VNC frame using $rot_{ECI2VNC}$ (final) and store Propagate the carrier platform forward by fractional orbital period Repeat iteration until sufficient number of cases N is reached FIG. 1 is a flow diagram illustrating a process of establishing an engagement volume for an SBI according to an embodiment.

A user may specify the orbital data of a carrier platform of interest (block 102), a maximum impulse velocity of an SBI launched from the carrier platform of interest (block 104) and a maximum expected time of flight (TOF) until intercept (block 108). Using a processor-based device, a family of interceptor imparted velocities is computed in a VNC frame (block 106). These data are used in conjunction with a launch platform propagator to determine an engagement volume over "N" release points using processor-based device (block 110).

A user may specify the orbital data of a targeted platform (block 120) and a time interval of interest (block 122). These data are used in conjunction with a targeted platform propagator to determine vulnerability timelines for the targeted platform using processor-based device (block 124). A visual representation of the engagement volume may be generated (block 130).

A determination is made whether the targeted platform is in the engagement volume (block 132). If the targeted platform is not in the engagement volume (that is, the result of block 132 is "No"), the process ends (block 134). If the targeted platform is in the engagement volume (that is, the result of block 132 is "Yes"), an alert is issued (block 136).

Figure 2:
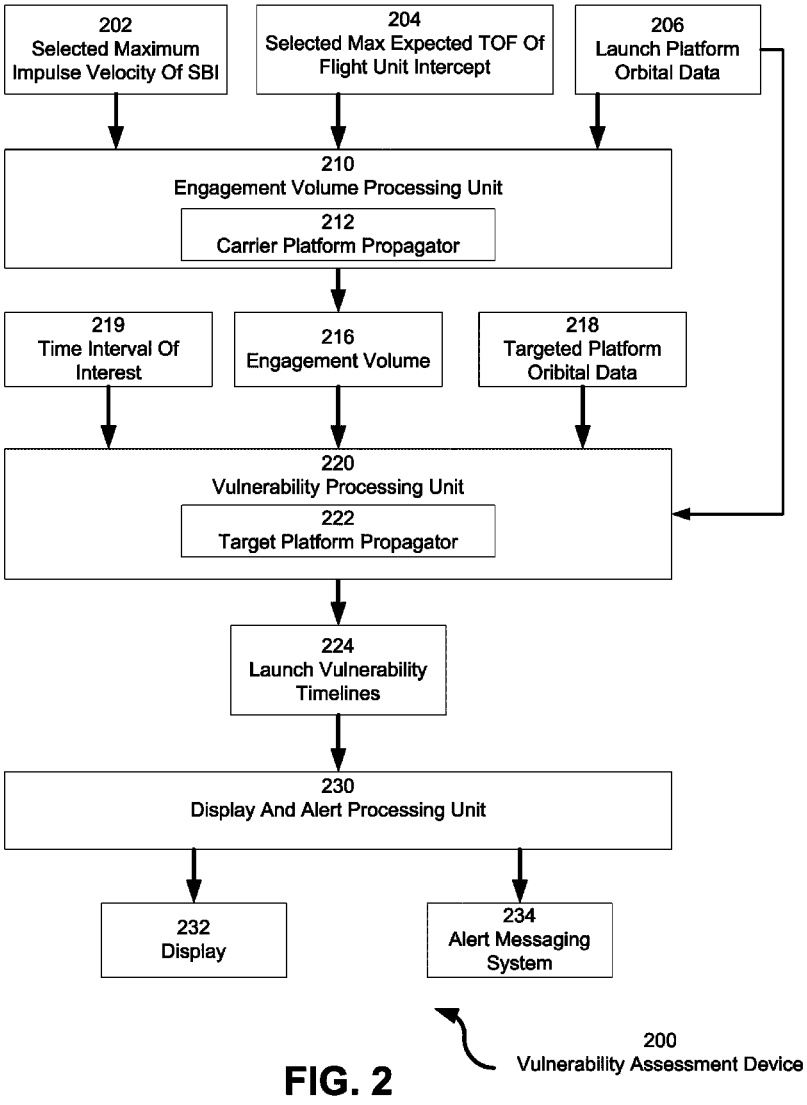
FIG. 2 is a block diagram illustrating a vulnerability assessment device according to an embodiment.

FIG. 2 is a block diagram illustrating a vulnerability assessment device according to an embodiment.

In an embodiment, a vulnerability assessment device 200 comprises an engagement volume processing unit 210, a vulnerability processing unit 220, a display and alert processing unit 230 and a display device 232.

The engagement volume processing unit 210 receives a maximum impulse velocity of an SBI launched from the carrier platform of interest from a data register 202, a maximum expected time of flight (TOF) until intercept from a data register 204, and orbital data of a carrier platform of interest from a data register 206. The engagement volume processing unit 210 determines a family of interceptor imparted velocities in a VNC frame and applies the family of velocities over "N" release points using a carrier platform propagator 212 to determine an engagement volume that is stored in the register 216.

The vulnerability processing unit 220 receives the engagement volume from the register 216. The vulnerability processing unit 220 also receives the carrier platform orbital data from the register 206 and a time interval of interest from the register 219. The vulnerability processing unit 220 applies these data using a targeted platform propagator 222 to determine launch vulnerability timelines that are stored in a register 224.

The display and alert processing unit 230 receives the launch vulnerability timelines from the register 224 to produce visual representation of the engagement volume on the display device 232. In another embodiment, the display and alert processor 230 issues an alert via an alert messaging system 234. In an embodiment, the alert messaging system may provide an alert on the display device 232. In another embodiment, the alert messaging system may communicate the alert via a text message or audio signal via a wired or wireless network (not illustrated).

Engagement Volume Representation

In an embodiment, the visual representation of the engagement volume produced by the display and alert processor 230 is represented as static points in space contained within a convex hull or a minimum volume enclosing ellipsoid. In an embodiment, the static vulnerability volume may be displayed relative to the carrier platform as it orbits the earth. If a particular satellite is predicted to pass through the volume then it is considered vulnerable.

Figure 3:
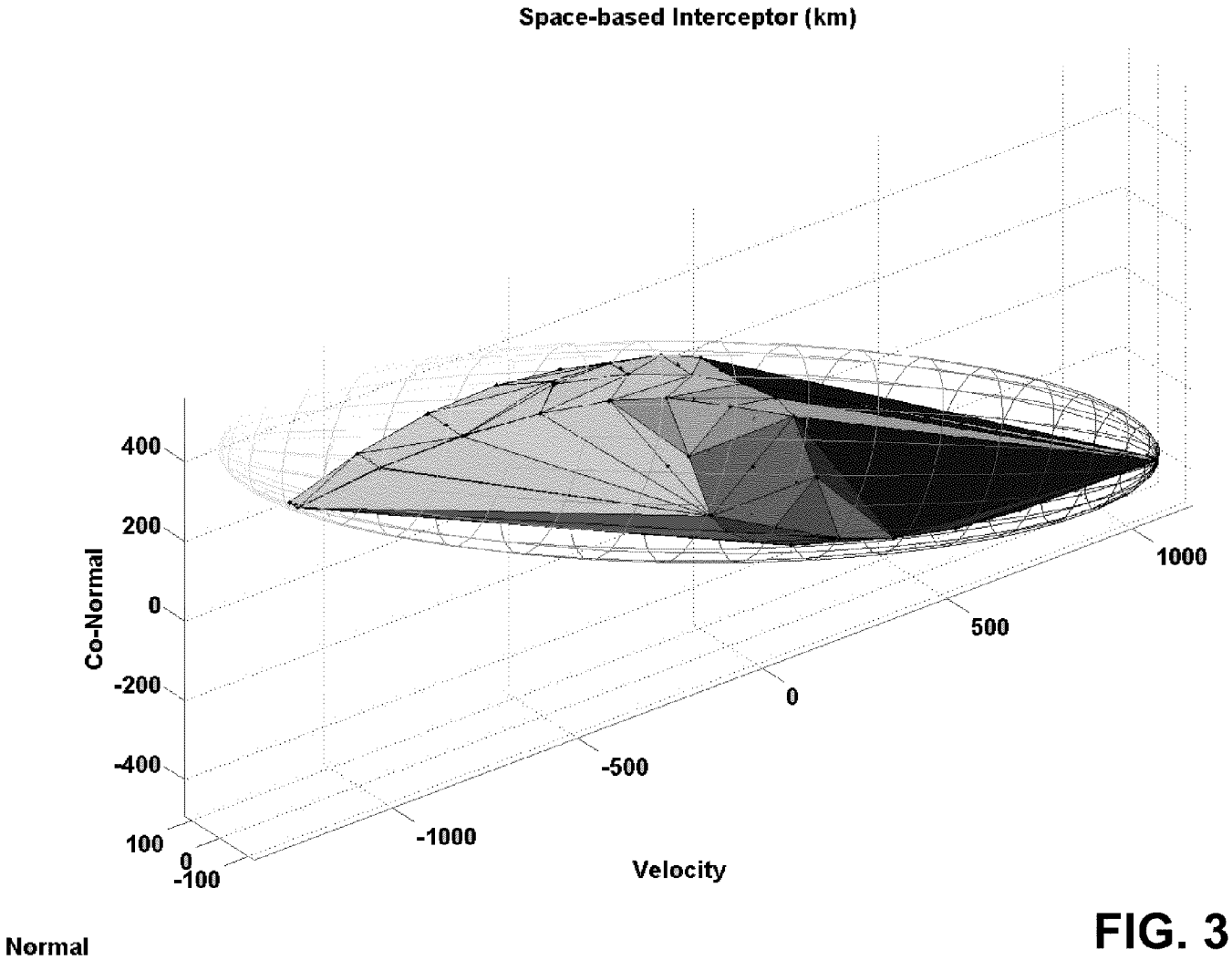
FIG. 3 is a graphical representation illustrating a static vulnerability volume enclosed by an ellipsoid according to an embodiment.

FIG. 3 is a graphical representation illustrating an engagement volume enclosed by an ellipsoid according to an embodiment. The engagement scenario depicts a 100 m/sec imparted velocity in all directions for a maximum time-of-flight of half an orbital period. The carrier platform has a semi-major axis of 6697 km and eccentricity of 0.001.

Although not discernible in FIG. 3, the center of the ellipsoid is not coincidental with the carrier platform and is not representative of the platform's covariance. Even though the volume enclosing ellipsoid contains all the points, it also contains empty space.

Figure 4:
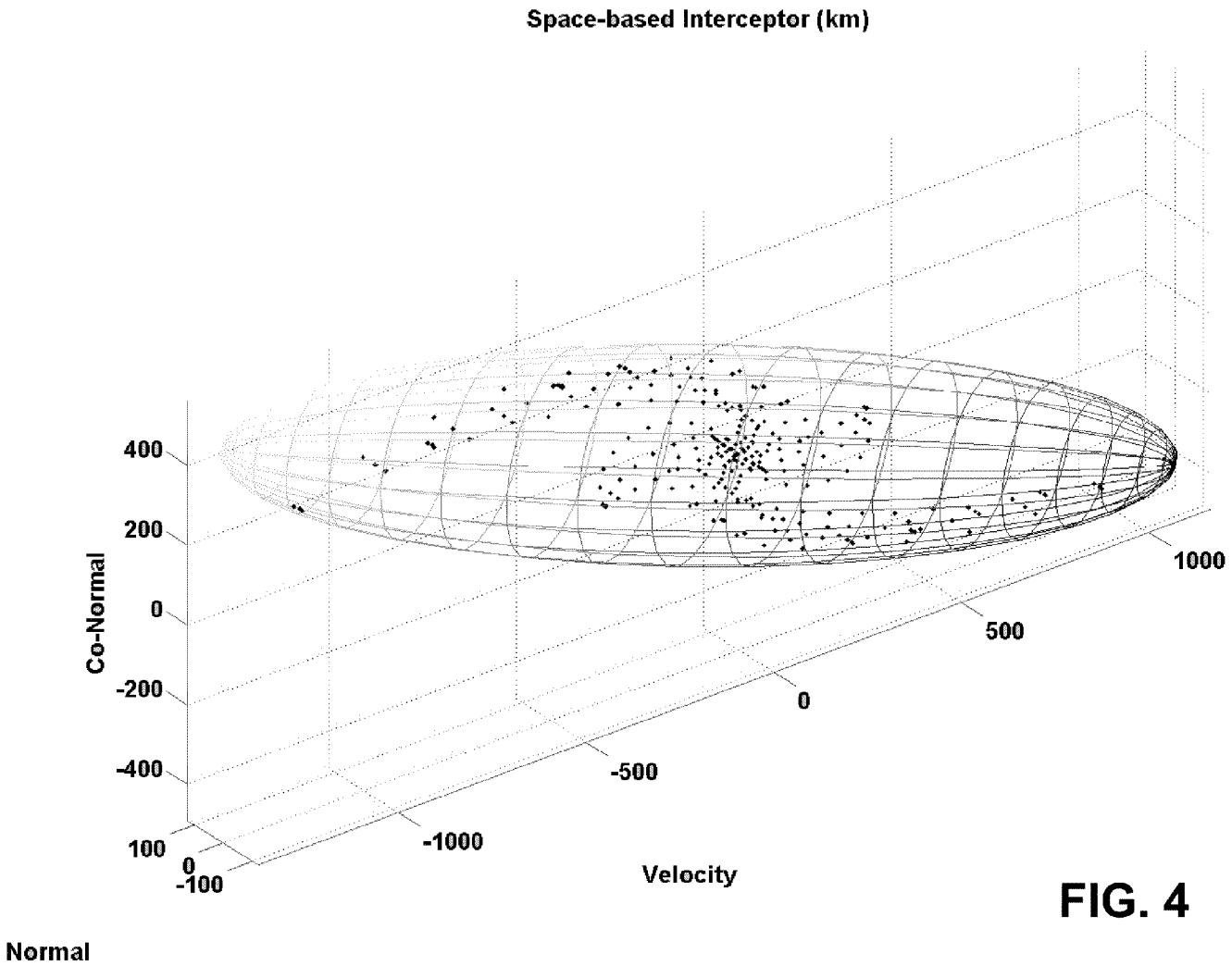
FIG. 4 is a graphical representation illustrating a static vulnerability volume enclosed by a convex hull according to an embodiment.

FIG. 4 is a graphical representation illustrating an engagement volume enclosed by a convex hull according to an embodiment. A convex hull may also be used to represent an engagement volume containing all the points. Such a depiction may be more computationally burdensome than the ellipsoid illustrated in FIG. 3 but may also be more representative of the vulnerability volume. FIG. 4 was generated using the same data points used in generating FIG. 3. The convex hull is shown inside the minimum volume enclosing ellipsoid to provide a sense of perspective and to highlight the ellipsoid's regions of empty space.

While the convex hull is the more accurate representation, the added computational burden associated with the convex hull may not be required.

The foregoing method descriptions and the process flow diagrams are provided merely as illustrative examples and are not intended to require or imply that the blocks of the various embodiments must be performed in the order presented. As will be appreciated by one of skill in the art the order of blocks in the foregoing embodiments may be performed in any order. Words such as "thereafter," "then," "next," etc. are not intended to limit the order of the blocks; these words are simply used to guide the reader through the description of the methods. Further, any reference to claim elements in the singular, for example, using the articles "a," "an," or "the," is not to be construed as limiting the element to the singular.

The various illustrative logical blocks, modules, circuits, and algorithm steps described in connection with the embodiments disclosed herein may be implemented as electronic hardware, computer software, or combinations of both. To clearly illustrate this interchangeability of hardware and software, various illustrative components, blocks, modules, circuits, and steps have been described above generally in terms of their functionality. Whether such functionality is implemented as hardware or software depends upon the particular application and design constraints imposed on the overall system. Skilled artisans may implement the described functionality in varying ways for each particular application, but such implementation decisions should not be interpreted as causing a departure from the scope of the present invention.

The hardware used to implement the various illustrative logics, logical blocks, modules, and circuits described in connection with the aspects disclosed herein may be implemented or performed with a general purpose processor, a digital signal processor (DSP), an application specific integrated circuit (ASIC), a field programmable gate array (FPGA) or other programmable logic device, discrete gate or transistor logic, discrete hardware components, or any combination thereof designed to perform the functions described herein. A general-purpose processor may be a microprocessor, but, in the alternative, the processor may be any conventional processor, controller, microcontroller, or state machine. A processor may also be implemented as a combination of computing devices, e.g., a combination of a DSP and a microprocessor, a plurality of microprocessors, one or more microprocessors in conjunction with a DSP core, or any other such configuration. Alternatively, some blocks or methods may be performed by circuitry that is specific to a given function.

In one or more exemplary aspects, the functions described may be implemented in hardware, software, firmware, or any combination thereof. If implemented in software, the functions may be stored on or transmitted over as one or more instructions or code on a computer-readable medium. The blocks of a method or algorithm disclosed herein may be embodied in a processor-executable software module, which may reside on a computer-readable medium. Computer-readable media includes both computer storage media and communication media including any medium that facilitates transfer of a computer program from one place to another. A storage media may be any available media that may be accessed by a computer. By way of example, and not limitation, such computer-readable media may comprise RAM, ROM, EEPROM, CD-ROM or other optical disk storage, magnetic disk storage or other magnetic storage devices, or any other medium that may be used to carry or store desired program code in the form of instructions or data structures and that may be accessed by a computer. Also, any connection is properly termed a computer-readable medium. For example, if the software is transmitted from a website, server, or other remote source using a coaxial cable, fiber optic cable, twisted pair, digital subscriber line (DSL), or wireless technologies such as infrared, radio, and microwave, then the coaxial cable, fiber optic cable, twisted pair, DSL, or wireless technologies such as infrared, radio, and microwave are included in the definition of medium. Disk and disc, as used herein, include compact disc (CD), laser disc, optical disc, digital versatile disc (DVD), floppy disk, and blu-ray disc where disks usually reproduce data magnetically, while discs reproduce data optically with lasers. Combinations of the above should also be included within the scope of computer-readable media. Additionally, the operations of a method or algorithm may reside as one or any combination or set of codes and/or instructions on a machine readable medium and/or computer-readable medium, which may be incorporated into a computer program product.

The preceding description of the disclosed embodiments is provided to enable any person skilled in the art to make or use the present invention. Various modifications to these embodiments will be readily apparent to those skilled in the art, and the generic principles defined herein may be applied to other embodiments without departing from the scope of the invention. Thus, the present invention is not intended to be limited to the embodiments shown herein but is to be accorded the widest scope consistent with the following claims and the principles and novel features disclosed herein.

What is claimed is:

1. A vulnerability assessment apparatus comprising:

an engagement volume processing unit, wherein the engagement volume processing unit comprises a first processor and wherein the first processor is configured with software executable instructions to cause the engagement volume processing unit to perform operations comprising:

receiving a maximum impulse velocity of a space-based interceptor (SBI) launched from a carrier platform of interest;

receiving a maximum time of flight (TOF) until intercept;

receiving orbital data of a carrier platform of interest;

determining a family of interceptor imparted velocities in a Velocity-Normal-Co-normal (VNC) frame; and applying the family of velocities over "N" release points using a carrier platform propagator to determine an engagement volume;

a display and alert processing unit, wherein the display and alert processing unit comprises a second processor and wherein the second processor is configured with software executable instructions to cause the display and alert processing unit to perform operations comprising:

generating a visual representation of the engagement volume; and sending the visual representation to the display device for display.

2. The apparatus of claim 1, wherein the second processor is further configured with software executable instructions to cause the display and alert processing unit to perform the operation of:

receiving orbital data of a targeted orbiting platform;

generating a visual representation of the orbital data of the targeted orbital platform relative to the engagement volume; and sending the visual representation of the orbital data of the targeted orbital platform to the display device for display.

3. The apparatus of claim 1 further comprising:

a vulnerability processing unit, wherein the vulnerability processing unit comprises a third processor and wherein the third processor is configured with software executable instructions to cause the vulnerability processing unit to perform operations comprising:

receiving the engagement volume from the engagement volume processing unit;

receiving orbital data of a targeted orbiting platform;

receiving a time interval of interest; and wherein the second processor is further configured with software executable instructions to cause the display and alert processing unit to perform operations comprising:

receiving the launch vulnerability timelines from the vulnerability processing unit;

determining launch vulnerability timelines from the engagement volume, the targeted orbital platform orbital data and the time interval of interest using a targeted platform propagator; and determining whether the targeted platform is in the engagement volume; and issuing an alert when the targeted platform is in the engagement volume.

4. The apparatus of claim 3, wherein the instruction for issuing an alert comprises an instruction for issuing an alert using at least one media selected from the group consisting of a visual alert, a text alert and an audio alert.

5. The apparatus of claim 1, wherein the engagement volume is selected from the group consisting of a convex hull and a minimum volume enclosing ellipsoid.

6. The apparatus of claim 1, wherein the operation of applying the family of velocities over "N" release points using a carrier platform propagator to determine an engagement volume comprises performing operations for each of the "N" release points comprising:

determining a rotation matrix $rot_{ECI2VNC}$ (initial) for the carrier platform of interest;

rotating a carrier platform initial position and velocity to a VNC frame;

propagating the carrier platform of interest using the carrier platform propagator over the maximum TOF;

computing a rotation matrix $rot_{ECI2VNC}$ (final) for the carrier platform of interest, where the notation "EcI2VNC" indicates the transformation from the Earth Centered Inertial frame to Velocity-Normal-Co-Normal frame;

for each possible velocity combination imparted to the SBI:

adding the possible imparted velocity combination to the carrier platform's initial VNC velocity;

propagating the SBI using the carrier platform propagator;

selecting points for visualization;

rotating the selected points to a final VNC frame using a $rot_{ECI2VNC}$ (final) matrix; and storing the rotated selected points as engagement volume data; and propagating the carrier platform forward by 1/N of an orbital period of the carrier platform of interest.

7. The apparatus of claim 6, wherein possible velocity combinations imparted to the SBI comprise:

$\Delta V_1=(V_{plus}\ N_{plus}\ C_{plus})^T$ $\Delta V_2=(V_{plus}\ N_{plus}\ 0)^T$ $\Delta V_3=(V_{plus}\ N_{plus}\ C_{minus})^T$ $\Delta V_4=(V_{plus}\ 0\ C_{plus})^T$ $\Delta V_5=(V_{plus}\ 0\ 0)^T$ $\Delta V_6=(V_{plus}\ 0\ C_{minus})^T$ $\Delta V_7=(V_{p1us}\ N_{minus}\ C_{p1us})^T$ $\Delta V_8=(V_{p1us}\ N_{minus}\ 0)^T$ $\Delta V_9=(V_{plus}\ N_{minus}\ C_{minus})^T$ $\Delta V_{10}=(0\ N_{p1us}\ C_{plus})^T$ $\Delta V_{11}=(0\ N_{plus}\ 0)^T$ $\Delta V_{12}=(0\ N_{plus}\ C_{minus})^T$ $\Delta V_{13}=(0\ 0\ C_{plus})^T$ $\Delta V_{14}=(0\ 0\ 0)^T$ $\Delta V_{15}=(0\ 0\ C_{minus})^T$ $\Delta V^{16}=(0\ N_{minus}\ C_{plus})^T$ $\Delta V_{17}=(0\ N_{minus}\ 0)^T$ $\Delta V_{18}=(0\ N_{minus}\ C_{minus})^T$ $\Delta V^{19}=(V_{minus}\ N_{plus}\ C_{plus})^T$ $\Delta V_{20}=(V_{minus}\ N_{plus}\ 0)^T$ $\Delta V_{21}=(V_{minus}\ N_{plus}\ C_{minus})^T$ $\Delta V_{22}=(V_{minus}\ 0\ C_{plus})^T$ $\Delta V_{23}=(V_{minus}\ 0\ 0)^T$ $\Delta V_{24}=(V_{minus}\ 0\ C_{minus})^T$ $\Delta V_{25}=(V_{minus}\ N_{minus}\ C_{plus})^T$ $\Delta V_{26}=(V_{minus}\ N_{minus}\ 0)^T$ $\Delta V_{27}=(V_{minus}\ N_{minus}\ C_{minus})^T$.

8. The apparatus of claim 1, wherein a first release point is at perigee and "N" is selected to include an apogee release point.

9. A method for determining the vulnerability of a targeted platform to a space based interceptor (SBI) comprising:

an engagement volume processing unit receiving a maximum impulse velocity of a space-based interceptor (SBI) launched from a carrier platform of interest;

the engagement volume processing unit receiving a maximum time of flight (TOF) until intercept;

the engagement volume processing unit receiving orbital data of the carrier platform of interest;

the engagement volume processing unit determining a family of interceptor imparted velocities in a Velocity-Normal-Co-normal (VNC) frame; and the engagement volume processing unit applying the family of velocities over "N" release points using a carrier platform propagator to determine an engagement volume;

a display and alert processing unit generating a visual representation of the engagement volume; and the display and alert processing unit sending the visual representation to the display device for display.

10. The method of claim 9 further comprising:

the display and alert processor receiving orbital data of a targeted orbiting platform;

the display and alert processor generating a visual representation of the orbital data of the targeted orbital platform relative to the engagement volume; and the display and alert processor sending the visual representation of the orbital data of the targeted orbital platform to the display device for display.

11. The method of claim 9 further comprising:

a vulnerability processing unit receiving the engagement volume from the engagement volume processing unit;

the vulnerability processing unit receiving orbital data of a targeted orbiting platform;

the vulnerability processing unit receiving a time interval of interest;

the display and alert processing unit receiving the launch vulnerability timelines from the vulnerability processing unit;

determining launch vulnerability timelines from the engagement volume, the targeted orbital platform orbital data and the time interval of interest using a targeted platform propagator;

determining whether the targeted platform is in the engagement volume; and issuing an alert when the targeted platform is in the engagement volume.

12. The method of claim 11, wherein issuing an alert when the targeted platform is in the engagement volume comprises issuing an alert using at least one media selected from the group consisting of a visual alert, a text alert and an audio alert.

13. The method of claim 9, wherein the engagement volume is selected from the group consisting of a convex hull and a minimum volume enclosing ellipsoid.

14. The method of claim 9, wherein applying by the engagement volume processing unit the family of velocities over "N" release points using a carrier platform propagator to determine an engagement volume comprises:

the engagement volume processing unit applying the family of velocities over "N" release points using a carrier platform propagator to determine an engagement volume;

the engagement volume processing unit, for each of the "N" release points:

determining a rotation matrix $rot_{ECI2VNC}$ (initial) for the carrier platform of interest;

rotating a carrier platform initial position and velocity to a VNC frame;

propagating the carrier platform of interest using the carrier platform propagator over the maximum TOF;

computing a rotation matrix $rot_{ECI2VNC}$ (final) for the carrier platform of interest;

for each possible velocity combination imparted to the SBI:

adding the possible imparted velocity combination to carrier platform's initial VNC velocity;

propagating the SBI using the carrier platform propagator;

selecting points for visualization;

rotating the selected points to a final VNC frame using a $rot_{ECI2VNC}$ (final) matrix; and storing the rotated selected points as engagement volume data; and propagating the carrier platform forward by 1/N of an orbital period of the carrier platform of interest.

15. The method of claim 14, wherein possible velocity combinations imparted to the SBI comprise:

$\Delta V_1=(V_{plus}\ N_{plus}\ C_{plus})^T$
$\Delta V_2=(V_{plus}\ N_{plus}\ 0)^T$
$\Delta V_3=(V_{plus}\ N_{plus}\ C_{minus})^T$
$\Delta V_4=(V_{plus}\ 0\ C_{plus})^T$
$\Delta V_5=(V_{plus}\ 0\ 0)^T$
$\Delta V_6=(V_{plus}\ 0\ C_{minus})^T$
$\Delta V_7=(V_{plus}\ N_{minus}\ C_{plus})^T$
$\Delta V_8=(V_{plus}\ N_{minus}\ 0)^T$
$\Delta V_9=(V_{plus}\ N_{minus}\ C_{minus})^T$
$\Delta V_{10}=(0\ N_{plus}\ C_{plus})^T$
$\Delta V_{11}=(0\ N_{plus}\ 0)^T$
$\Delta V_{12}=(0\ N_{plus}\ C_{minus})^T$
$\Delta V^{13}=(0\ 0\ C_{plus})^T$
$\Delta V_{14}=(0\ 0\ 0)^T$
$\Delta V_{15}=(0\ 0\ C_{minus})^T$
$\Delta V_{16}=(0\ N_{minus}\ C_{plus})^T$
$\Delta V_{17}=(0\ N_{minus}\ 0)^T$
$\Delta V_{18}=(0\ N_{minus}\ C_{minus})^T$
$\Delta V^{19}=(V_{minus}\ N_{plus}\ C_{plus})^T$
$\Delta V_{20}=(V_{minus}\ N_{plus}\ 0)^T$
$\Delta V_{21}=(V_{minus}\ N_{plus}\ C_{minus})^T$
$\Delta V_{22}=(V_{minus}\ 0\ C_{plus})^T$
$\Delta V_{23}=(V_{minus}\ 0\ 0)^T$
$\Delta V_{24}=(V_{minus}\ 0\ C_{minus})^T$
$\Delta V_{25}=(V_{minus}\ N_{minus}\ C_{plus})^T$
$\Delta V_{26}=(V_{minus}\ N_{minus}\ 0)^T$
$\Delta V_{27}=(V_{minus}\ N_{minus}\ C_{minus})^T$.

16. The method of claim 15, wherein a first release point is at perigee and "N" is selected to include an apogee release point.

* * * * *